US012185773B2

(12) United States Patent
Beland

(10) Patent No.: US 12,185,773 B2
(45) Date of Patent: Jan. 7, 2025

(54) CONFIGURABLE SHIN GUARD

(71) Applicant: SPORT MASKA INC., Montreal (CA)

(72) Inventor: Jean-François Beland, Montréal (CA)

(73) Assignee: SPORT MASKA INC., St-Laurent (CA)

( * ) Notice: Subject to any disclaimer, the term of this patent is extended or adjusted under 35 U.S.C. 154(b) by 120 days.

(21) Appl. No.: 17/931,573

(22) Filed: Sep. 13, 2022

(65) Prior Publication Data

US 2023/0079906 A1 Mar. 16, 2023

Related U.S. Application Data

(60) Provisional application No. 63/244,335, filed on Sep. 15, 2021.

(51) Int. Cl.

| | |
|---|---|
| ***A41D 13/05*** | (2006.01) |
| ***A63B 69/00*** | (2006.01) |
| ***A63B 71/12*** | (2006.01) |

(52) U.S. Cl.

CPC ..... *A41D 13/0543* (2013.01); *A63B 69/0024* (2013.01); *A63B 2071/1258* (2013.01); *A63B 2209/10* (2013.01)

(58) Field of Classification Search

CPC ..... A41D 13/0543; A63B 69/0024; A63B 69/0026; A63B 2071/1258; A63B 2071/125; A63B 2071/1266; A63B 2071/1241

See application file for complete search history.

(56) References Cited

U.S. PATENT DOCUMENTS

| | | | | |
|---|---|---|---|---|
| 11,241,609 | B2 * | 2/2022 | Gauvin | A63B 71/1225 |
| 2002/0184693 | A1 * | 12/2002 | Beland | A63B 71/1225 2/22 |
| 2018/0364011 | A1 * | 12/2018 | Blakeley | F41H 1/02 |
| 2021/0137184 | A1 * | 5/2021 | Abram | B32B 27/302 |
| 2022/0322762 | A1 * | 10/2022 | Wong | A41D 13/0543 |

* cited by examiner

*Primary Examiner* — Khoa D Huynh
*Assistant Examiner* — Erick I Lopez
(74) *Attorney, Agent, or Firm* — NORTON ROSE FULBRIGHT CANADA

(57) ABSTRACT

A shin guard for a hockey player includes a knee portion having a knee cap adapted to cover a knee of the hockey player, and a shin portion located below the knee portion and extending from a lower end adapted to be proximate a foot of the hockey player toward the knee cap to cover a shin of the hockey player. The shin portion includes a shin cap having an outer side facing away from the shin and an inner side facing toward the shin, a main padded liner overlapping at least a portion of the inner side of the shin cap, and a shin comfort liner mounted internally of the main padded liner. The shin comfort liner is movable relative to the shin cap between first and second positions, the shin comfort liner moving away from the knee cap from the first position to the second position.

13 Claims, 6 Drawing Sheets

CONFIGURABLE SHIN GUARD

CROSS-REFERENCE TO RELATED APPLICATIONS

The present application claims priority benefit of U.S. Patent Application No. 63/244,335 filed Sep. 15, 2021, the entire content of which is incorporated herein by reference.

TECHNICAL FIELD

This disclosure generally relates protective sports equipment and, more particularly, to leg pads for hockey players.

BACKGROUND

Hockey players wear leg pads for protecting their shins and knees. These leg pads are commonly referred to as "shin guards", although they typically also cover the knee region of the wearer. Typically, hockey players wear such shin guards in one of two possible positions: with a lower edge of the shin pad covering the tongue of their skates (often referred to as a "tongues in" position); or with the lower edge of the shin pad inside the tongue of their skates, such that the skate tongues cover the lower edge of the shin pad (often referred to as a "tongues out" position). In some cases, known shin guards may be ill-adapted to either one of these two configurations. Improvements are therefore sought.

SUMMARY

In one aspect, there is provided a shin guard for a hockey player, comprising: a knee portion having a knee cap adapted to cover a knee of the hockey player; and a shin portion located below the knee portion and extending from a lower end adapted to be proximate a foot of the hockey player toward the knee cap to cover a shin of the hockey player, the shin portion having: a shin cap having an outer side facing away from the shin and an inner side facing toward the shin, a main padded liner overlapping at least a portion of the inner side of the shin cap, and a shin comfort liner mounted internally of the main padded liner and movable relative to the shin cap between a first position and a second position, the shin comfort liner moving away from the knee cap from the first position to the second position.

The shin guard as defined above and described herein may have any of the following features, in whole or in part, and in any combination.

In certain embodiments, the main padded liner has a bottom section, the shin comfort liner overlapping the bottom section in the second position and at least partially offset from the bottom section in the first position.

In certain embodiments, the bottom section is defined by a bottom padded liner secured to a top section of the main padded liner adjacent a bottom edge of the top section of the main padded liner, the shin comfort liner overlapping the bottom padded liner in the second position and being offset from the bottom padded liner in the first position.

In certain embodiments, the bottom padded liner includes a top edge, a bottom edge, and lateral and medial edges extending from the top edge to the bottom edge, the bottom padded liner secured to the main padded liner solely via the lateral and medial edges of the bottom padded liner, the bottom padded liner protruding beyond the top section of the main padded liner such that a gap is defined between the top edge of the bottom padded liner and a bottom edge of the top section of the main padded liner.

In certain embodiments, the shin cap is directly secured to the bottom padded liner, a spacing defined between the shin cap and the top section of the main padded liner to provide a sling effect to the shin cap, the shin cap free of the spacing at a bottom section of the shin cap.

In certain embodiments, the bottom padded liner includes a non-Newtonian material.

In certain embodiments, a thickness of the shin portion at the lower end of the shin portion is less in the first position than in the second position to create a gap for receiving a tongue of a skate of the hockey player between the shin portion and the shin when the shin comfort liner is in the first position.

In certain embodiments, the shin comfort liner includes a body and a tab secured to the body, the tab slidably received within a sleeve defined by the main padded liner, the shin comfort liner movable between the first position and the second position by a sliding motion of the tab in the sleeve.

In certain embodiments, the tab is removably securable to the main padded liner by matingly engageable female and male fasteners.

In certain embodiments, the matingly engageable female and male fasteners are hook-and-loop fasteners.

In certain embodiments, the tab protrudes beyond a top edge of the shin comfort liner.

In certain embodiments, a bottom edge of the main padded liner is aligned with a bottom edge of the shin comfort liner in the first position and offset from the bottom edge of the shin comfort liner in the second position.

In certain embodiments, a travel length of the shin comfort liner between first and second positions corresponds to a length of an end portion of a tongue of a skate.

In another aspect, there is provided a shin guard for a hockey player, comprising: a knee portion having a knee cap covering a knee of the hockey player; and a shin portion located below the knee portion and extending from a lower end proximate a foot of the hockey player toward the knee cap to cover a shin of the hockey player, the shin portion having: a shin cap having an outer side facing away from the shin and an inner side facing toward the shin, a main padded liner overlapping at least the inner side of the shin cap, and a shin comfort liner mounted internally of the main padded liner and having a first fixed portion secured to the main padded liner and a second removable portion removably securable to the main padded liner or to the first fixed portion, the second removable portion filling a gap located between a shin of a wearer and a bottom section of the main padded liner, the gap sized to accommodate an end portion of a tongue of a skate of the hockey player.

The shin guard as defined above and described herein may have any of the following features, in whole or in part, and in any combination.

In certain embodiments, the second removable portion is securable to the first fixed portion of the shin comfort liner via matingly engageable female and male fasteners.

In certain embodiments, the bottom section of the main padded liner is defined by a bottom padded liner secured to a top section of the main padded liner adjacent a bottom edge of the top section of the main padded liner, the second removable portion overlapping the bottom padded liner.

In certain embodiments, a bottom edge of the bottom padded liner is aligned with a bottom edge of the second removable portion of the shin comfort liner when the second removable portion is attached to the first fixed portion.

In certain embodiments, the shin cap is directly secured to the bottom padded liner, a spacing defined between the shin cap and the main padded liner to provide a sling effect to the shin cap, the shin cap free of the spacing at the bottom padded liner.

In a further aspect, there is provided a method of adjusting a shin guard of a hockey player, comprising: providing the shin guard having a knee portion including a knee cap covering a knee of the hockey player, a shin portion located below the knee portion and extending from a lower end proximate a foot of the hockey player toward the knee cap to cover a shin of the hockey player, the shin portion including a shin cap, a main padded liner overlapping at least a portion of an inner side of the shin cap, and a shin comfort liner, the main padded liner having a bottom section proximate the foot of the hockey player; moving the shin comfort liner away from the bottom section of the main padded liner to create a gap between the bottom section and the shin of the hockey player, and inserting an end portion of a tongue of a skate within the gap between the bottom section and the shin; or disposing the shin comfort liner between the bottom section of the main padded liner and the shin of the hockey player, and abutting the tongue of the skate on an outer side of the shin cap.

In certain embodiments, the method further includes moving the shin comfort liner includes moving the shin comfort liner in an upward direction away from the bottom section of the main padded liner.

Many further features and combinations thereof concerning the present improvements will appear to those skilled in the art following a reading of the instant disclosure.

DETAILED DESCRIPTION

Figure 1:
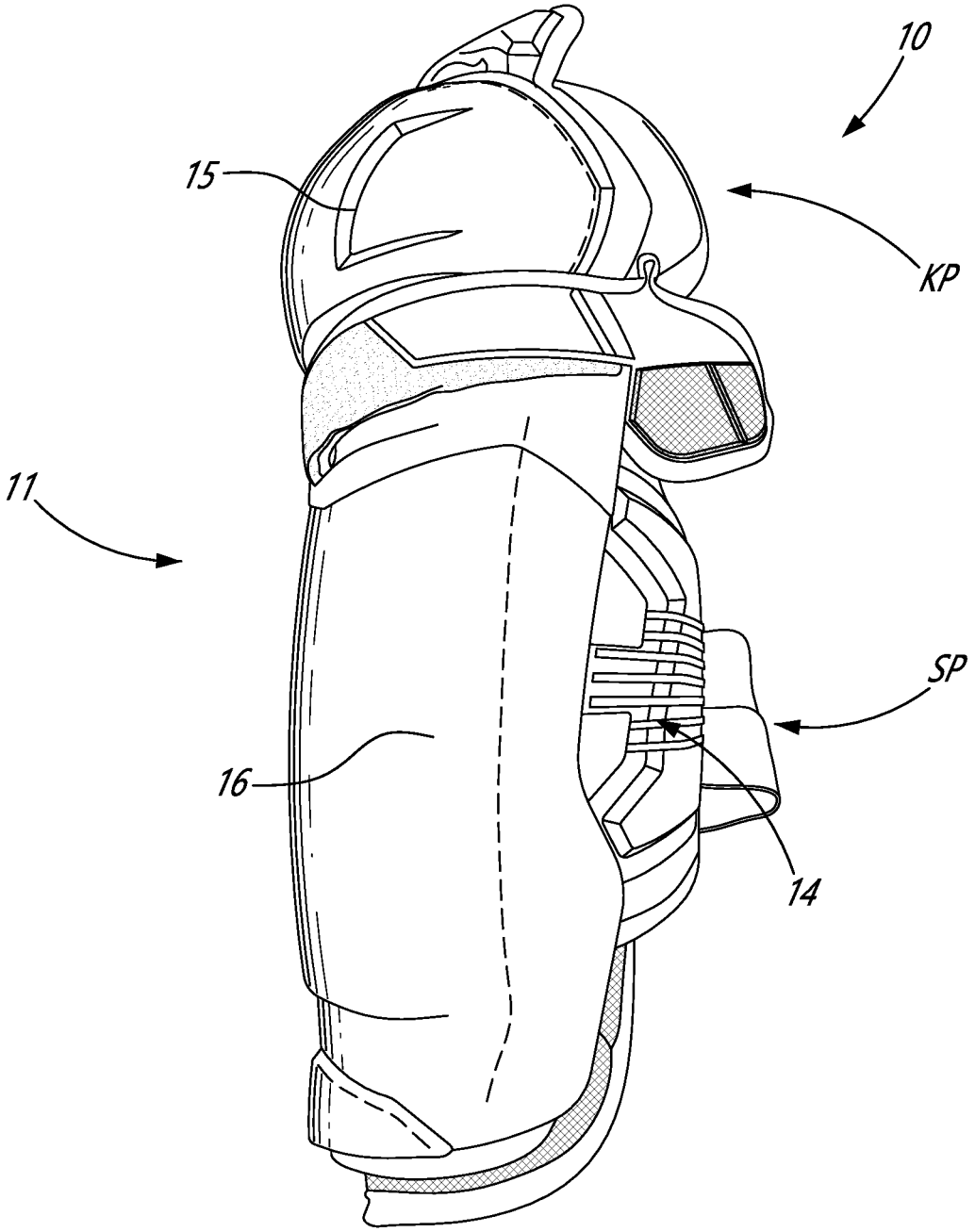
FIG. 1 is a three dimensional view of a shin guard in accordance with one embodiment.
Figure 2:
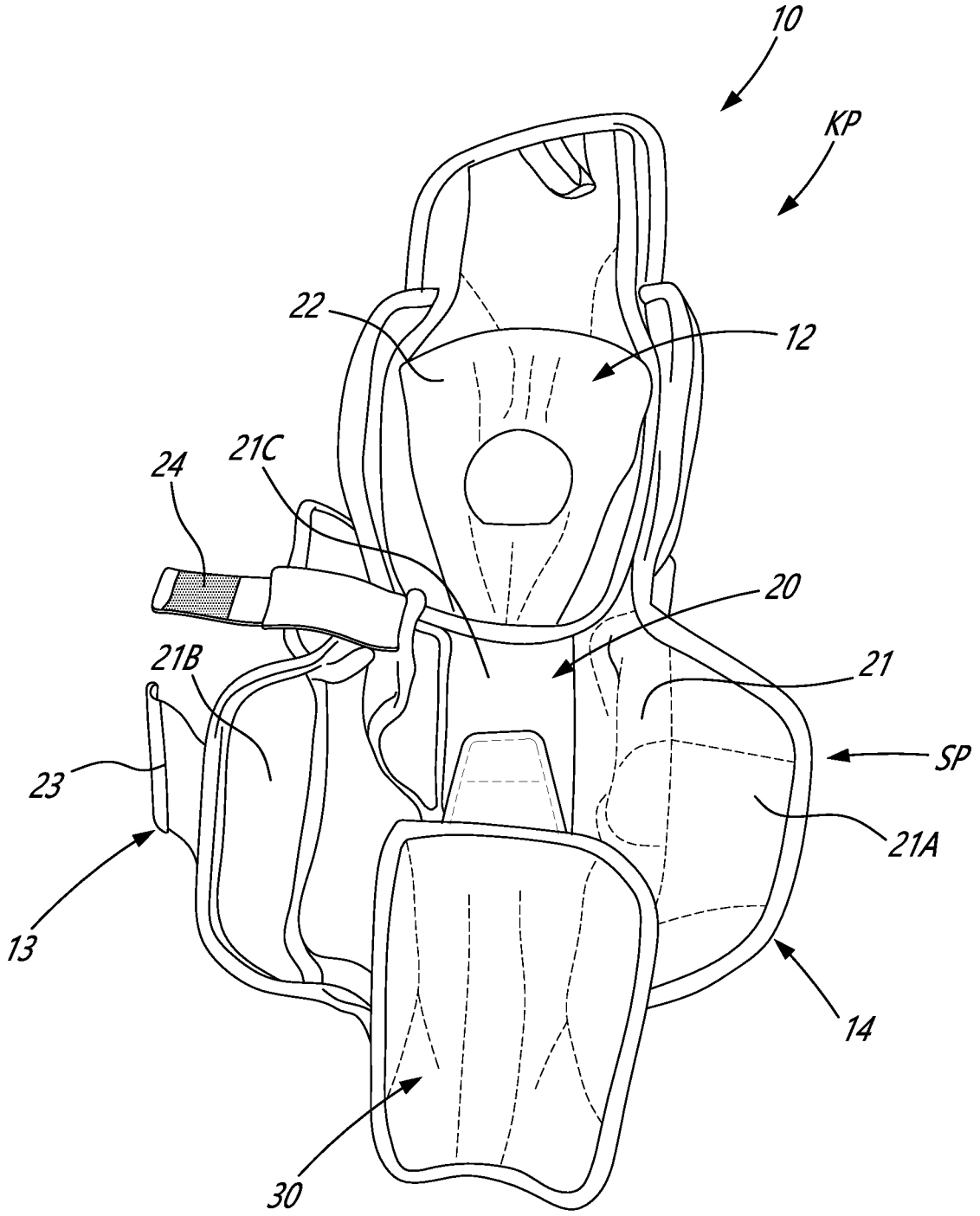
FIG. 2 is an inner view of the shin guard of FIG. 1.

Referring to FIGS. 1-2, a shin guard is shown at 10. The shin guard 10 is adapted to be worn by an ice hockey player (e.g. a "wearer" herein) such that it covers a shin and the knee of the wearer. The shin guard 10 has an outer side 11 facing away from the shin, an inner side 12 facing the shin, a medial side 13, and a lateral side 14. The medial sides of left and right shin guards face one another. The shin guard 10 shown in FIG. 1 is a left shin guard. It will be appreciated that a right shin guard may be a mirror image of the shin guard 10 shown in FIG. 1.

Still referring to FIGS. 1-2, the shin guard 10 generally includes a knee portion KP and a shin portion SP located below the knee portion. The knee portion KP includes a knee cap 15 that defines part of the outer side 11 of the shin guard 10 and is used for covering a knee of the wearer. The shin portion SP includes a shin cap 16 that also defines part of the outer side of the shin guard 10 and covers a shin of the wearer. The shin portion SP extends from a lower end proximate a foot of the wearer towards the knee cap 15 to cover a shin of the wearer. The knee cap 15 and the shin cap 16 may be two different sections of a single monolithic cap or may be two different caps secured to one another, either directly or via paddings of the shin guard 10. In the present embodiment, the knee cap 15 and the shin cap 16 are separate parts movable with respect to one another. The shin cap 16 has an outer side facing away from the shin and an inner side facing the shin. The inner side is concave for accepting a portion of the shin of the wearer. The inner side 12 of the shin guard 10 includes a padding assembly 20 to create a dampening layer between the shin cap 16 and the knee cap 15 and the shin of the wearer. This padding assembly 20 may be used to dampen impacts, for instance of a puck, imparted on the caps of the shin guard 10.

The padding assembly 20 includes a core pad, also referred to as a main padded liner 21, that is secured (e.g., stitched) to the shin cap 16. The main padded liner 21 may also be stitched to the knee cap 15. The main padded liner 21 may overlap at least an inner side of the shin cap 16. In the present embodiment, the main padded liner 21 overlaps the shin cap 16 and the knee cap 15. The main padded liner 21 may be made of any suitable dampening material, such as foam, for suitably protecting the leg of the wearer. A knee comfort liner 22 and a shin comfort liner 30 are mounted internally of the main padded liner 21. The comfort liners 22, 30 may improve a comfort of the shin guard 10 for the wearer. The liners may be made with any suitable materials. The main padded liner 21 defines a medial wing 21A and a lateral wing 21B that are sized to at least partially wrap around a calf of the wearer for securing the shin guard 10 to the wearer. A strap 23 may be used to secure the medial wing 21A to the lateral wing 21B. A second strap 24 may be used to secure the shin guard 10 to the wearer. The second strap 24 may be located above the strap 23. Any suitable fastening means, such as hook-and-loop fasteners, snap buttons, and so on, may be used for the strap 23 and the second strap 24.

Figure 3A:
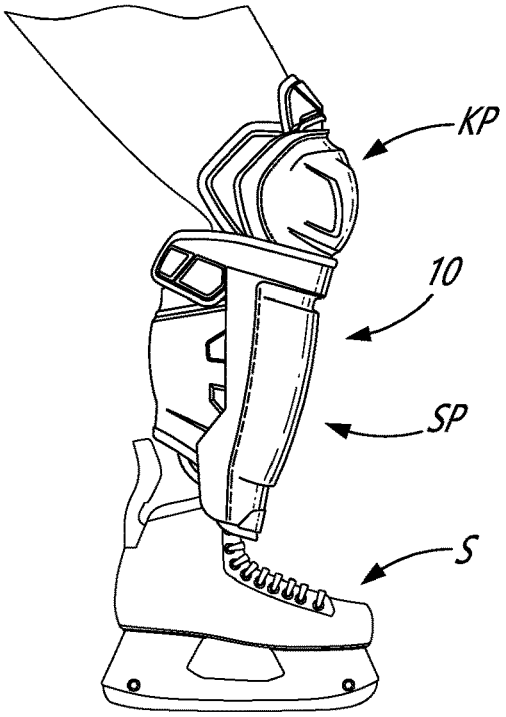
FIG. 3A is a side view of the shin guard of FIG. 1 shown in a "tongues-in" configuration.
Figure 4A:
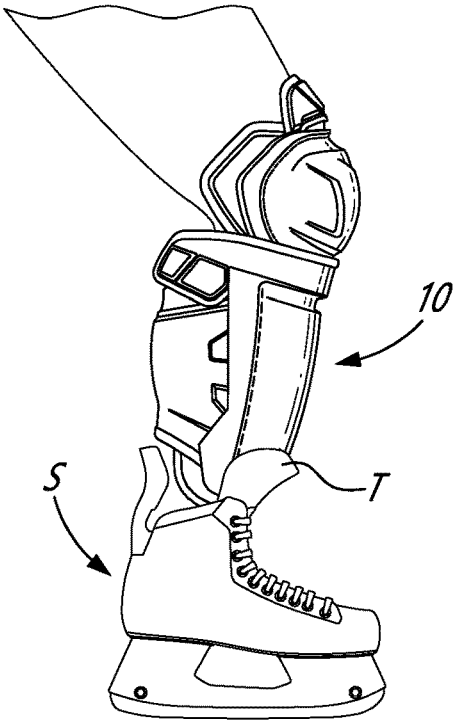
FIG. 4A is a side view of the shin guard of FIG. 1 shown in a "tongues-out" configuration.

Depending on their personal preference, hockey players can wear the shin guard 10 either in a "tongues-in" configuration as shown in FIG. 3A or a "tongues-out" configuration as shown in FIG. 4A.

In the tongues-in configuration as shown in FIG. 3A, the tongue T of the skate S is sandwiched between the shin guard 10 and the shin of the wearer, and the bottom section of the shin guard 10 partially overlaps and covers the tongue T of the skate S such that the tongue T is facing and abuts against the inner side 12 of the shin guard 10.

In the tongues-out configuration as shown in FIG. 4A, a bottom section of the shin guard 10 is partially received within a skate S such that a tongue T of the skate S is located outside of and partially overlaps and covers a bottom section of the shin guard 10. In such a case, the tongue T is facing and abuts against the outer side of the shin guard 10. As shown, the bottom section of the shin guard 10 is sandwiched between the tongue T and the shin of the wearer.

The choice between these two configurations is made by the hockey player, based on their individual preference. However, it has been observed that when known shin guards are worn by players in the "tongues-in" configuration, the bottom of such existing shin guards is sticking out away from the leg because of the added and unforeseen tongue material between the shin of the wearer and the shin guard. This is impractical and cumbersome, and may be uncomfortable for the wearer. The shin guard 10 of the present disclosure may at least partially alleviate these drawbacks.

Figure 3B:
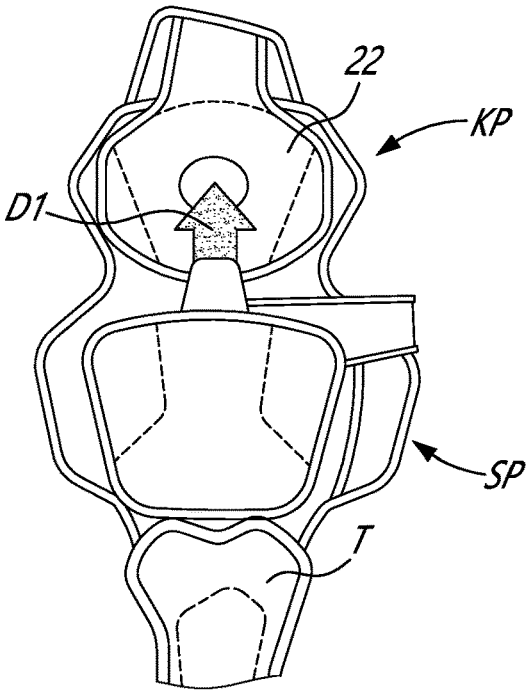
FIG. 3B is an inner view of the shin guard of FIG. 1 shown in the "tongues-in" configuration.
Figure 4B:
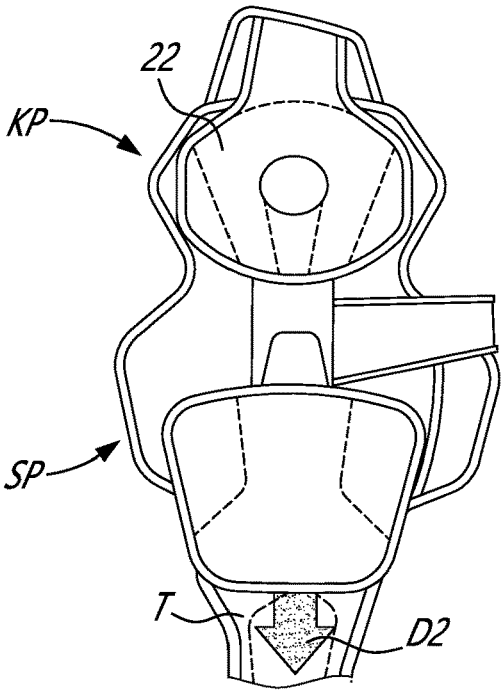
FIG. 4B is an inner view of the shin guard of FIG. 1 shown in the "tongues-out" configuration.

Referring more particularly to FIGS. 3B and 4B, in the embodiment shown, the shin comfort liner 30 of the shin portion of the shin guard 10 is removably securable to the main padded liner 21 at a plurality of possible positions as a function of whether the shin guard 10 is to be used in the "tongues-in" or "tongues-out" configurations. A first position of the shin comfort liner 30 is shown in FIG. 3B and corresponds to the "tongues-in" configuration of the shin guard 10 whereas a second position of the shin comfort liner 30 is shown in FIG. 4B and corresponds to the "tongues-out" position of the shin comfort liner 30.

As illustrated in FIGS. 3B and 4B, a distance between the shin comfort liner 30 and the knee comfort liner 22 is greater in the second position of the shin comfort liner 30 of FIG. 4B than in the first position of the shin comfort liner 30 of FIG. 4A. Stated differently, in the first position depicted in FIG. 3B, the shin comfort liner 30 is positioned higher than in the second position depicted in FIG. 4B. In the first position of FIG. 3B, the shin comfort liner 30 is located above a top end of the tongue T. In this position, the top end of the tongue T may be substantially flush or aligned with a bottom edge of the shin comfort liner 30. Hence, when the tongue T is to be worn inside the shin guard 10, the shin comfort liner 30 may be moved upward along direction D1 towards the knee comfort liner 22 to reduce a thickness of the shin portion at the lower end of the shin portion of the shin guard 10 where it is overlapping the skate S. As shown in FIG. 4B, when the tongue T is to be worn outside the shin guard 10, the shin comfort liner 30 may be moved downward along direction D2 away from the knee comfort liner 22 to increase the thickness of the shin portion at the lower end thereof. The reduced thickness of the shin portion in the first position (e.g., "tongues-in" configuration) of the shin comfort liner 30 (FIG. 3B) may creates a gap for receiving the tongue T of the skate S between the shin portion and the shin of the wearer. In the second position depicted in FIG. 4B, the shin comfort liner 30 may be positioned to go all the way down so as to be fushl with a bottom of the shin guard as such portion will be in direct contact with the shin of the wearer whereas, in the first position depicted in FIG. 3B, the shin comfort liner 30 is moved upwards to free up space for the tongue T.

A method of adjusting the shin guard 10 may thus include moving the shin comfort liner away from the bottom section of the main padded liner to create a gap between the bottom section and the shin of the hockey player, and inserting an end portion of the tongue T within the gap between the bottom section and the shin; or disposing the shin comfort liner 30 between the bottom section of the main padded liner 21 and the shin of the wearer, and abutting the tongue T of the skate on the outer side of the shin cap 16. In the present embodiment, the moving the shin comfort liner 30 includes moving the shin comfort liner 30 in an upward direction away from the bottom section of the main padded liner 21.

A travel length or travel distance of the shin comfort liner 30 between the first and second positions may substantially correspond to a length of an end portion of the tongue T of the skate S. The end portion of the tongue T may correspond to the end that is not overlapped by laces of the skate S and that protrudes outwardly from a boot section of the skate S.

Figure 5:
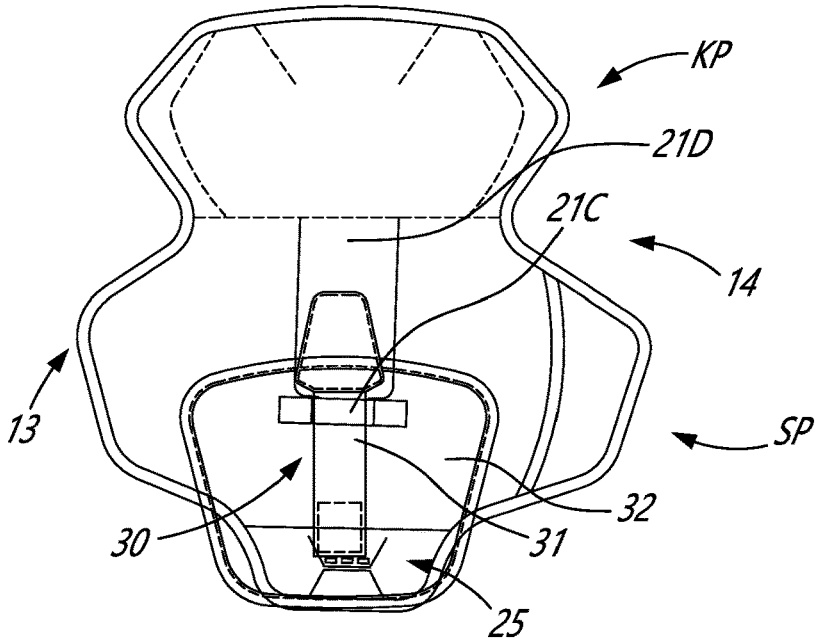
FIG. 5 is an inner plan view of the shin guard of FIG. 1 with parts removed for illustration purposes illustrating the shin guard in the "tongues-out" configuration.
Figure 6:
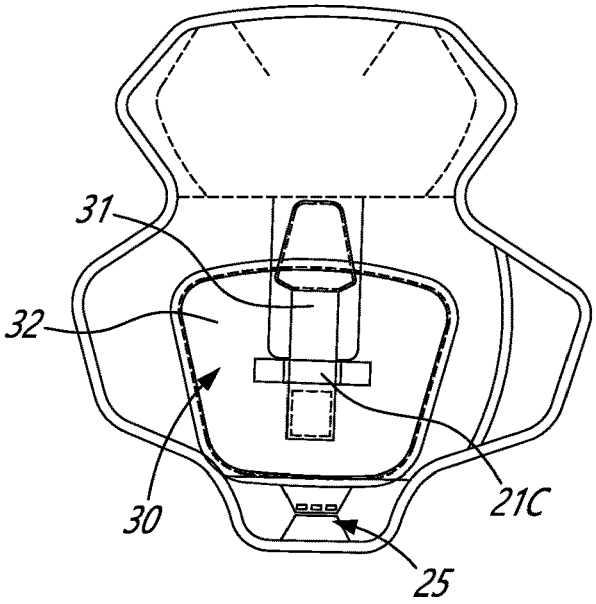
FIG. 6 is an inner plan view of the shin guard of FIG. 1 with parts removed for illustration purposes illustrating the shin guard in the "tongues-in" configuration.
Figure 7:
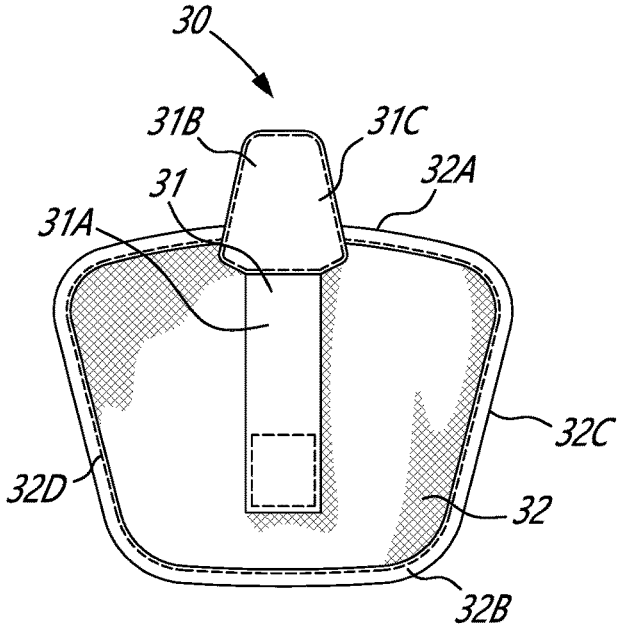
FIG. 7 is a plan view of a shin comfort liner of the shin guard of FIG. 1.

Referring now to FIGS. 5-7, the main padded liner 21 and the shin comfort liner 30 are shown in the "tongues-in" configuration (FIG. 6) and in the "tongues-out" configuration (FIG. 5). The main padded liner 21 includes a sleeve 21C that is sized to receive a tab 31 secured to a main body 32 of the shin comfort liner 30. The tab 31 is slidably received within the sleeve 21C to allow the shin comfort liner 30 to be moved between the first and second positions depicted in FIGS. 5 and 6, respectively.

The main body 32 of the shin comfort liner 30 has a top edge 32A, a bottom edge 32B, a medial edge 32C extending from the top edge 32A to the bottom edge 32B, and a lateral edge 32D extending from the top edge 32A to the bottom edge 32B. The tab 31 is secured to the main body 32 between the top edge 32A and the bottom edge 32B and between the medial edge 32C and the lateral edge 32D. The tab 31 may be centered between the medial edge 32C and the lateral edge 32D. The tab 31 may be secured at a location closer to the bottom edge 32B than to the top edge 32A to allow sufficient movement amplitude between the first and second positions.

The tab 31 includes a main section 31A and a bulge section 31B. The main section 31A is secured at one end to the main body 32 of the shin comfort liner 30 and at an opposite end to the bulge section 31B. The main section 31A may be made of a plastic material to ease a sliding motion within the sleeve 21C. The bulge section 31B has a width greater than that of the main section 31A and greater than an opening defined by the sleeve 21C. Consequently, the bulge section 31B may prevent the shin comfort liner 30 from separating from the main padded liner 21 of the shin guard 10. The bulge section 31B protrudes upwardly beyond the top edge 32A of the shin comfort liner 30 to allow the wearer to easily grab the bulge section 31B to adjust the position of the shin comfort liner 30 as he or she wants. The bulge section 31B may define a first fasteners 31C matingly engageable to a second fastener 21D secured to the main padded liner 21. The first and second fasteners 31C, 21D may be hook-and-loop fasteners or any other suitable fastening means (e.g., snap buttons, etc.).

As shown in FIG. 5, when the shin guard 10 is in the "tongues-out" position, the bottom edge 32B of the shin comfort liner 30 is substantially aligned with a bottom edge of the main padded liner 21. The main padded liner 21 includes a top section and a bottom section. In the present embodiment, the bottom section is defined by a bottom padded liner 25 that is secured to the top section of the main padded liner 21. A width of the shin comfort liner 30 is greater than a width of the bottom padded liner 25 such that the shin comfort liner 30 protrudes laterally and medially beyond the bottom section of the main padded liner 21, herein defined by the bottom padded liner 25. This may have the advantage of providing increased tongue coverage, and therefore protection, of the leg above the ankle portion. As shown in FIG. 6, when the shin guard 10 is in the "tongues-in" position, the bottom edge 32B of the shin comfort liner 30 is offset from the bottom edge of the main padded liner 21 and the bottom padded liner 25 is substantially free of an overlap with the shin comfort liner 30.

Figure 8:
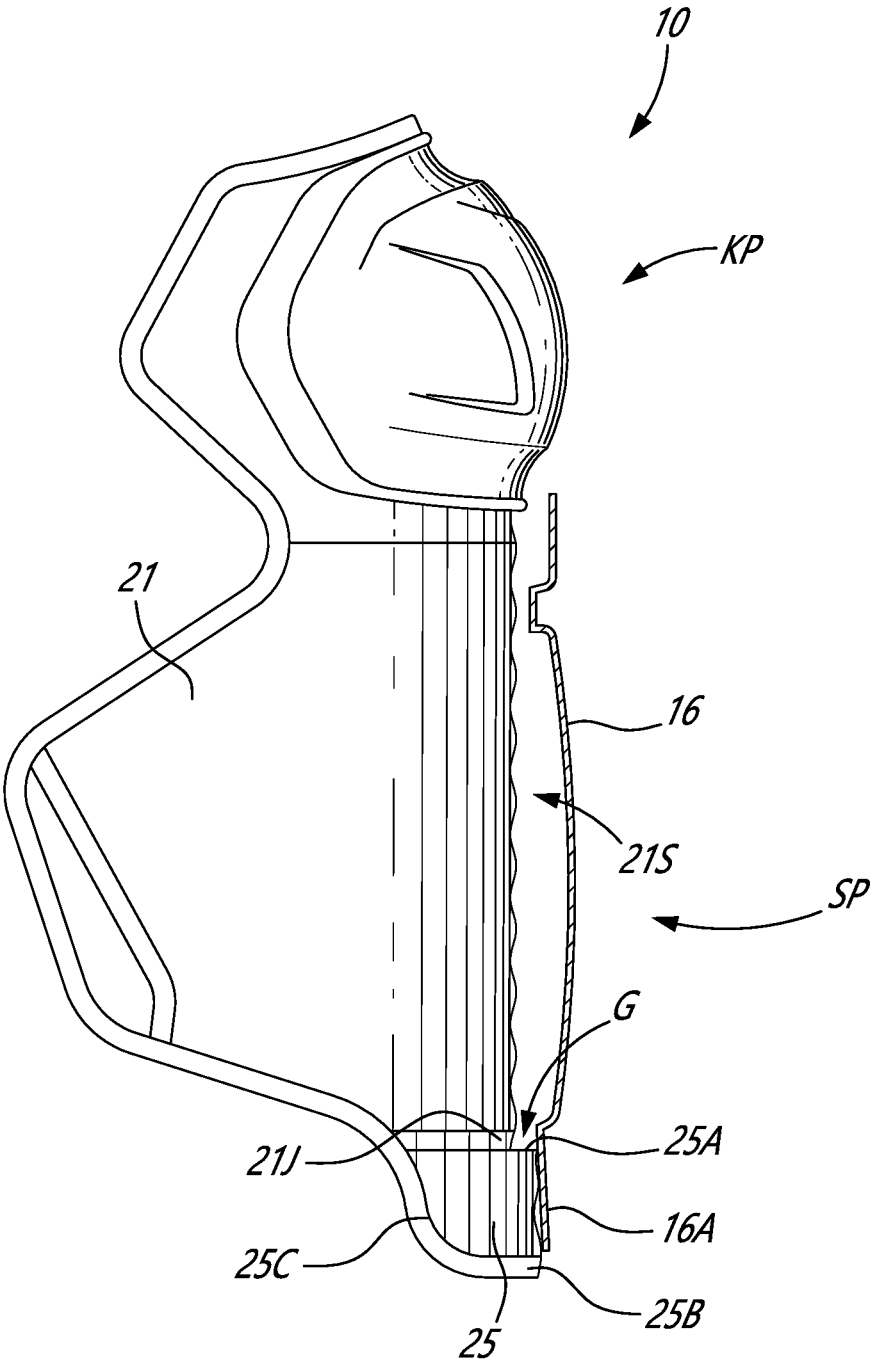
FIG. 8 is a side partially cutaway view of the shin guard of FIG. 1.

Referring to FIG. 8, the bottom padded liner 25 includes a top edge 25A, a bottom edge 25B, and lateral and medial edges 25C extending from the top edge 25A to the bottom edge 25B. The bottom padded liner 25 may be secured to the top section of the main padded liner 21 solely via the lateral and medial edges 25C of the bottom padded liner 25. The bottom padded liner 25 may protrude beyond the top section of the main padded liner 21 such that a gap G is defined between the top edge 25A of the bottom padded liner 25 and a bottom edge 21J of the top section of the main padded liner 21.

In the embodiment shown, a bottom section 16A of the shin cap 16 is directly secured to the bottom padded liner 25. And, a remainder of the shin cap 16 is spaced apart from the top section of the main padded liner 21 by a spacing 21S. In other words, the top section of the main padded liner 21 is spaced apart from the shin cap 16 by the spacing 21S and may not extend all the way to a bottom of the shin cap 16. In other words, a portion of the shin cap 16 protrudes downwardly beyond the top section of the main padded liner 21. The shin cap 16 is free of the spacing at the bottom section 16A of the shin cap 16. This spacing 21S creates a "sling" effect such that when an impact is imparted on the shin cap 16, the shin cap 16 may deflect and bend inward toward the top section of the main padded liner 21 thereby decreasing a thickness of the spacing 21S. Hence, the impact on the shin cap 16 may not propagate to the main padded liner 21 thanks to the spacing 21S.

In the embodiment shown, the bottom padded liner 25 is abutted against the shin cap 16. Therefore, there is no sling effect between the shin cap 16 and the bottom padded liner 25. This configuration may allow the creation of additional space to receive the tongue T. In an alternate embodiment, the bottom padded liner 25 may be omitted and the main padded liner 21 may extend all the way to a bottom edge of the shin cap 16. In this alternate embodiment, only a thickness of the comfort liner 30 may be available for the tongue T. In the embodiment shown, in the "tongues-in" configuration of FIG. 3B, the additional space for receiving the tongue T is created by a thickness of the shin comfort liner 30, which is moved upwardly so as to clear the space for the tongue T, and the absence of the sling effect between the shin cap 16 and the bottom padded liner 25, which is in abutment against the shin cap 16. A height of the bottom padded liner 25 may be selected so as to contain an entirety of a top section of the tongue T. And, the shin comfort liner 30 may be able to move upwardly a distance corresponding to at least the height of the top section of the tongue T.

However, the spacing 21S may not reach the bottom padded liner 25, which may be, as explained above, a separate element joined by stitching to a remainder of the main padded liner 21. As shown in FIG. 8, the bottom padded liner 25 protrudes outwardly from the top section of the main padded liner 21 to bridge a gap that might otherwise be present between the bottom padded liner 25 and the bottom section 16A of the shin cap 16. Hence, the bottom section 16A of the shin cap 16 may not provide the "sling" effect discussed above. To compensate, the bottom padded liner 25 may be made of material having greater dampening properties than that of a remainder of the main padded liner 21. This material may include, for instance, a non-Newtonian foam, a higher density polyethylene foam, or a vinyl-nitrile foam.

Having the bottom section 16A of the shin cap 16 free of the spacing 21S, or, stated otherwise, having the bottom section 16A of the shin cap 16 directly secured to the bottom section of the main padded liner 21, may decrease a thickness of the shin guard 10 extending from the inner side of the main padded liner 21 to the outer side of the shin cap 16. This reduced thickness may provide sufficient space for receiving the tongue T between the shin guard 10 and the shin of the wearer when in the "tongues-in" configuration.

Figure 9:
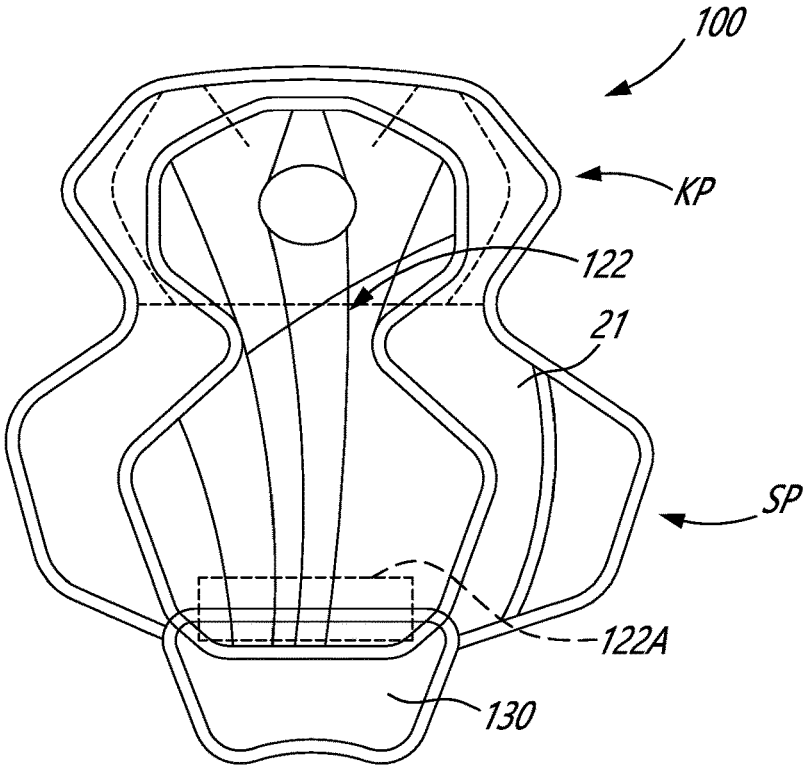
FIG. 9 is a view of a shin guard in accordance with another embodiment shown in the "tongues-out" configuration.
Figure 10:
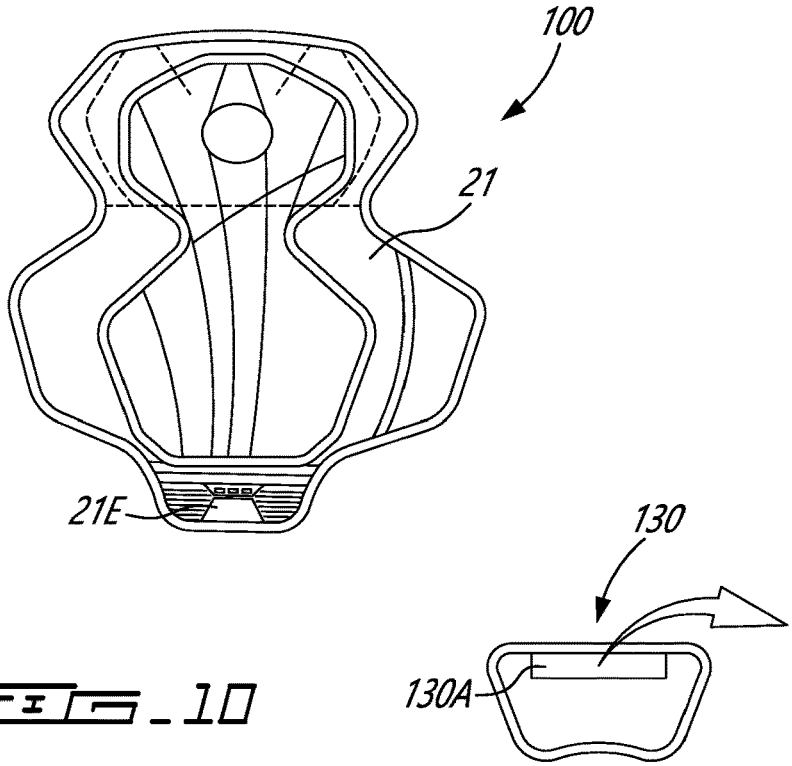
FIG. 10 is a plan view of the shin guard of FIG. 9 shown in the "tongues-in" configuration.

Referring now to FIGS. 9-10, an alternate embodiment of a shin guard is shown at 100. For the sake of conciseness, only elements that differ from the shin guard 10 described above with reference to FIGS. 1-8 are described below.

In the embodiment shown, the shin guard 100 includes shin comfort liner that has a first fixed portion 122 that overlaps both of the knee cap 15 and the shin cap 16. The first fixed portion 122 is secured to the main padded liner 21. However, in some embodiments, it may be removable. Hook-and-loop fasteners may be used to removably secure the first fixed portion 122 to the main padded liner 21. Any other suitable fastening means may be used. In some cases, they may be permanently secured to one another.

The shin guard 100 includes a removable liner, also referred to as a second removable portion, 130 that may be removably securable to the first fixed portion 122. To this effect, the first fixed portion 122 has a first fastener 122A matingly engageable to a second fastener 130A secured to the removable liner 130. The first and second fasteners 122A, 130A may be hook-and-loop fasteners or any other suitable fastening means. When the removable liner 130 is secured to the first fixed portion 122, a portion of the removable liner 130 is sandwiched between the first fixed portion 122 and the main padded liner 21. The removable liner 130 may alternatively, or in combination, be securable to the main padded liner 21.

In the present embodiment, a thickness of the shin portion at the lower end of the shin portion is less with the removable portion 130 being detached than with the removable portion 130 being attached to the bottom section. Hence, a gap may be created for receiving the tongue T of the skate S of the hockey player. The gap may be defined between the shin portion and the shin when the removable portion 130 is detached.

If the wearer wishes to use the shin guard 100 in the "tongues-in" configuration, he or she may simply pull on the removable liner 130 to detach it from the liner 122. Alternatively, if the "tongues-out" configuration is chosen, the removable liner 130 may be secured using the first and second fasteners 122A, 130A.

The disclosed shin guards 10, 100 may sit closer and deeper around the leg compared to a traditional shin guard that sits too far away when worn in a "tongues-in" configuration. The disclosed shin guards 10, 100 may provide a performance and comfort benefit for the wearer who may quickly configure his or her shin guard to either one of the "tongues-in" or "tongues-out" configurations. They may allow better and closer fit to the leg and better interaction with the skate at least in the "tongues-in" configuration.

As can be seen therefore, the examples described above and illustrated are intended to be exemplary only. The scope is indicated by the appended claims.

What is claimed is:

1. A shin guard for a hockey player, comprising:

a knee portion having a knee cap adapted to cover a knee of the hockey player; and a shin portion located below the knee portion and extending from a lower end of the shin portion adapted to be proximate a foot of the hockey player toward the knee cap to cover a shin of the hockey player, the shin portion having:

a shin cap having an outer side configured for facing away from the shin and an inner side configured for facing toward the shin, a main padded liner overlapping at least a portion of the inner side of the shin cap, the main padder liner extending from a top liner end to a bottom liner end, and a shin comfort liner mounted internally of the main padded liner and movable relative to the shin cap between a first position and a second position, the shin comfort liner moving away from the knee cap from the first position to the second position, wherein in the first position:

the shin comfort liner is located entirely between the top liner end and the bottom liner end; and a bottom end of the shin comfort liner is offset upwardly from the bottom liner end.

2. The shin guard of claim 1, wherein the main padded liner has a bottom section, the shin comfort liner overlapping the bottom section in the second position and at least partially offset from the bottom section in the first position.

3. The shin guard of claim 2, wherein the bottom section is defined by a bottom padded liner secured to a top section of the main padded liner adjacent a bottom edge of the top section of the main padded liner, the shin comfort liner overlapping the bottom padded liner in the second position and being offset from the bottom padded liner in the first position.

4. The shin guard of claim 3, wherein the bottom padded liner includes a top edge, a bottom edge, and lateral and medial edges extending from the top edge to the bottom edge of the bottom padded liner, the bottom padded liner secured to the main padded liner solely via the lateral and medial edges of the bottom padded liner, the bottom padded liner protruding beyond the top section of the main padded liner such that a gap is defined between the top edge of the bottom padded liner and the bottom edge of the top section of the main padded liner.

5. The shin guard of claim 4, wherein the shin cap is directly secured to the bottom padded liner, a spacing defined between the shin cap and the top section of the main padded liner to provide a sling effect to the shin cap, the shin cap free of the spacing at a bottom section of the shin cap.

6. The shin guard of claim 3, wherein the bottom padded liner includes a non-Newtonian material.

7. The shin guard of claim 1, wherein a thickness of the shin portion at the lower end of the shin portion is less in the first position than in the second position to create a gap for receiving a tongue of a skate of the hockey player between the shin portion and the shin when the shin comfort liner is in the first position.

8. The shin guard of claim 1, wherein the shin comfort liner includes a body and a tab secured to the body, the tab slidably received within a sleeve defined by the main padded liner, the shin comfort liner movable between the first position and the second position by a sliding motion of the tab in the sleeve.

9. The shin guard of claim 8, wherein the tab is removably securable to the main padded liner by matingly engageable female and male fasteners.

10. The shin guard of claim 9, wherein the matingly engageable female and male fasteners are hook-and-loop fasteners.

11. The shin guard of claim 8, wherein the tab protrudes beyond a top edge of the shin comfort liner.

12. The shin guard of claim 1, wherein a bottom edge of the main padded liner is aligned with a bottom edge of the shin comfort liner in the first second position and offset from the bottom edge of the shin comfort liner in the second first position.

13. The shin guard of claim 1, wherein a travel length of the shin comfort liner between the first position and the second position is configured to correspond to a length of an end portion of a tongue of a skate.

* * * * *